US005743715A

United States Patent [19]

Staroselsky et al.

[11] Patent Number: 5,743,715

[45] Date of Patent: Apr. 28, 1998

[54] METHOD AND APPARATUS FOR LOAD BALANCING AMONG MULTIPLE COMPRESSORS

[75] Inventors: Serge Staroselsky, West Des Moines; Brett W. Batson, Dallas Center; Saul Mirsky; Vadim Shapiro, both of West Des Moines, all of Iowa

[73] Assignee: Compressor Controls Corporation, Des Moines, Iowa

[21] Appl. No.: 546,114

[22] Filed: Oct. 20, 1995

[51] Int. Cl.[6] ..... F04B 41/06; F04B 49/00

[52] U.S. Cl. ..... 417/6; 417/2; 417/3; 417/4; 417/5; 417/18; 417/19; 417/20; 417/22; 417/42; 417/44.1; 417/53; 415/1; 415/17; 62/175; 364/431.02

[58] Field of Search ..... 417/1, 2–6, 17, 417/18–23, 26, 32, 42, 44.1, 44.2, 53, 44.3; 415/1, 17, 26–28, 49–50; 364/431.02; 62/228.3, 228.4, 175

[56] References Cited

U.S. PATENT DOCUMENTS

| | | | |
|---|---|---|---|
| Re. 30,329 | 7/1980 | Rutshtein et al. | 415/1 |
| 3,979,655 | 9/1976 | Rutshtein et al. | 415/11 |
| 3,994,623 | 11/1976 | Rutshtein et al. | 417/19 |
| 4,046,490 | 9/1977 | Rutshtein et al. | 417/28 |
| 4,203,701 | 5/1980 | Abbey | 415/1 |
| 4,464,720 | 8/1984 | Agarwal | 364/431.02 |
| 4,494,006 | 1/1985 | Staroselsky et al. | 417/5 |
| 4,526,513 | 7/1985 | Bogel | 417/5 |
| 4,640,665 | 2/1987 | Staroselsky et al. | 415/1 |
| 4,656,589 | 4/1987 | Albers et al. | 364/431.02 |
| 4,825,380 | 4/1989 | Hobbs | 415/11 |
| 4,831,535 | 5/1989 | Blotenberg | 364/431.02 |
| 4,861,233 | 8/1989 | Dziubakowski et al. | 415/27 |
| 4,949,276 | 8/1990 | Staroselsky | 364/431.02 |
| 4,971,516 | 11/1990 | Lawless et al. | 415/1 |
| 5,195,875 | 3/1993 | Gaston | 415/27 |
| 5,306,116 | 4/1994 | Gunn et al. | 415/27 |
| 5,347,467 | 9/1994 | Staroselsky et al. | 364/431.02 |
| 5,508,943 | 4/1996 | Batson et al. | 364/431.02 |

OTHER PUBLICATIONS

Manual—149–pages from Compressor Controls Corporation printed 1987–1995 and entitled Series 3 Plus Performance Controller for Centrifugal and Axial Compressors—Publication IM302 (4.0) Software Revision: 953–002 Jul., 1995.

*Primary Examiner*—Timothy Thorpe
*Assistant Examiner*—Xuan M. Thai
*Attorney, Agent, or Firm*—Henderson & Sturm

[57] ABSTRACT

Balancing the load between compressors is not trivial. An approach is disclosed to balance loads for compression systems which have the characteristic that the surge parameters, S, change in the same direction with rotational speed during the balancing process. Load balancing control involves equalizing the pressure ratio, rotational speed, or power (or functions of these) when the compressors are operating far from surge. Then, as surge is approached, all compressors are controlled, such that they arrive at their surge control lines simultaneously.

60 Claims, 5 Drawing Sheets

METHOD AND APPARATUS FOR LOAD BALANCING AMONG MULTIPLE COMPRESSORS

TECHNICAL FIELD

This invention relates generally to a method and apparatus for load balancing turbocompressor networks. More particularly, the invention relates to a method for distributing the load shared by compressors, which prevents excessive recycling when it becomes necessary to protect the compressors from surge.

BACKGROUND ART

When two or more compressors are connected in series or parallel, surge protection and process efficiency can be maximized by operating them equidistant from their surge limits when they are not recycling, and by equalizing their recycle flow rates when they are.

Present-day control systems for compressor networks consist of a master controller, one load-sharing controller associated with each driver, and one antisurge controller for every compressor. A system like this uses several complementary features to interactively maintain a desired pressure or flow rate while simultaneously keeping a relationship between compressors constant, and protecting the compressors from surge. One such feature is load balancing which keeps the compressors the same distance from surge to avoid unnecessary recycling.

DISCLOSURE OF THE INVENTION

The purpose of this invention is to provide a method for distributing the load shared by compressors in networks-such as gas transport (pipeline) compressors-which have the characteristic that the surge parameters for all compressors change in the same direction with speed changes, during the balancing process. However, many compression systems have similar characteristics and can be controlled using this approach that acknowledges the efficiency role in avoiding recycling, or blowing off gas, for antisurge control whenever possible. The invention describes a load balancing technique to minimize recycle while balancing pressure ratios or rotational speeds anytime recycle is not imminent.

The controlled variable is the subject of this invention, and examples of the manipulated parameter are rotational speed, inlet guide vanes, and suction throttle valves. For this technique, the compressor map is divided into three regions plus a small transition region as depicted in FIG. 1.

Region 1

When the compressor is not threatened by surge due to being near the surge control line, values such as pressure ratio, rotational speed, or power can be balanced in a predetermined way between compressors in the series network.

Region 2

If any of the compressor's operating points move toward the surge control line, all compressors can be kept an equal distance from their respective surge control lines, thereby postponing any recycling until all compressors in the network reach their control lines.

Region 3

At the point when all compressors are recycling, it is advantageous to manipulate the performance of all compressors so that all are recycling equally.

Transition Region

This area, between Regions 1 and 2, is for smoothly transferring control between the different process variables used in these two regions.

BEST MODE FOR CARRYING OUT THE INVENTION

When compressors can all be operated "far from surge," it is advisable to distribute the pressure ratio across all compressors in a predefined fashion. Running in such a manner as to maximize efficiency may be in order when compressors are driven by gas turbines.

Figure 2:
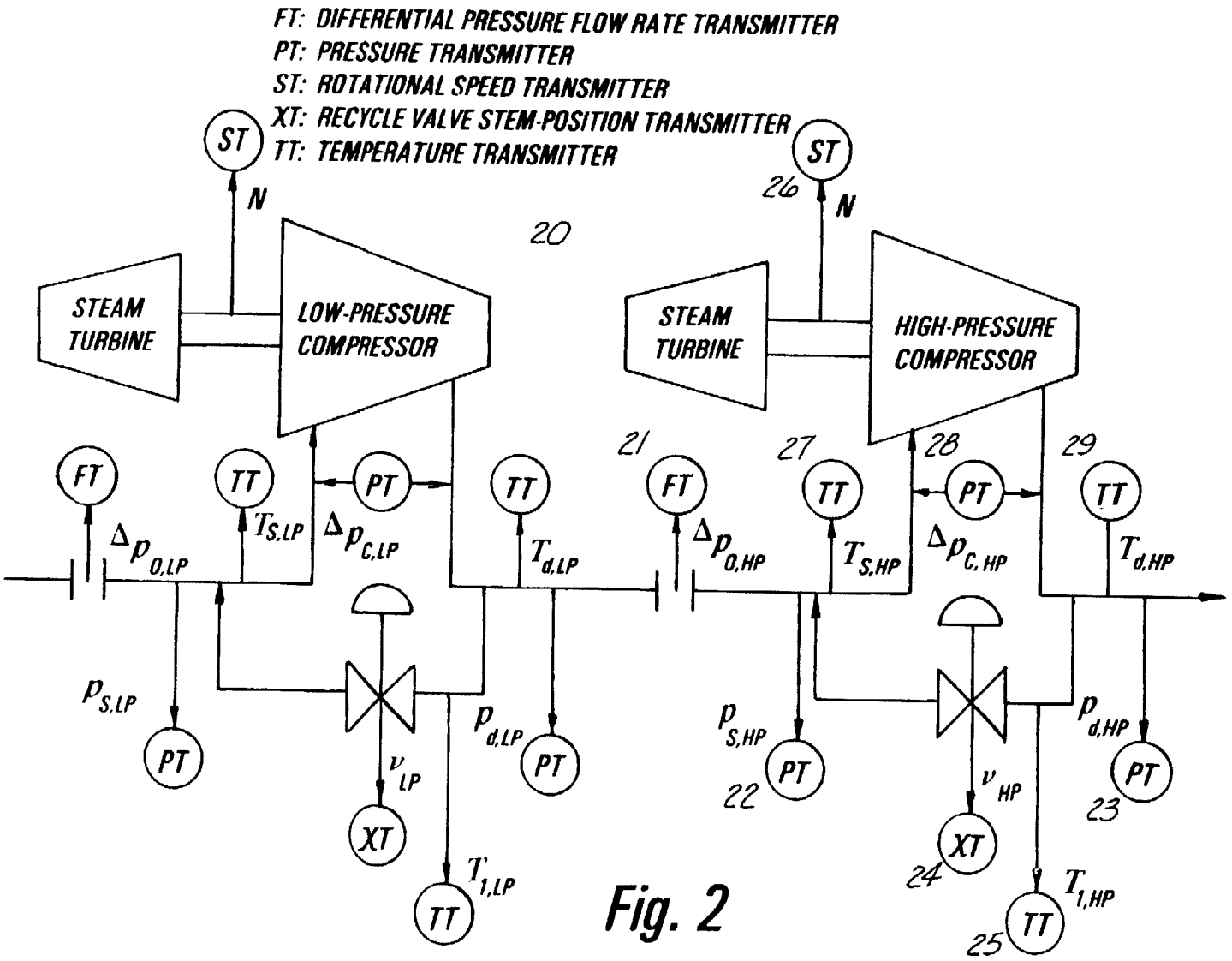
FIG. 2 shows a schematic diagram representing a series compressor network and control scheme.

For compressor networks, efficiency and safety are both realized by prudently distributing the load shared by the compressors. FIG. 2 depicts such a network arrangement with two turbocompressors in series 20, both driven by steam turbines. Each compressor incorporates a separate control scheme comprising devices for monitoring process input signals, such as differential pressure across a flow measurement device 21 and across a compressor 28, pressure in suction 22, and pressure at discharge 23. This system also includes transmitters for recycle valve stem position 24, valve inlet temperature 25, suction temperature 27, discharge temperature 29, and rotational speed 26 data. These and other signals interact and are input as a balancing parameter to a Load Sharing Controller.

Figure 1:
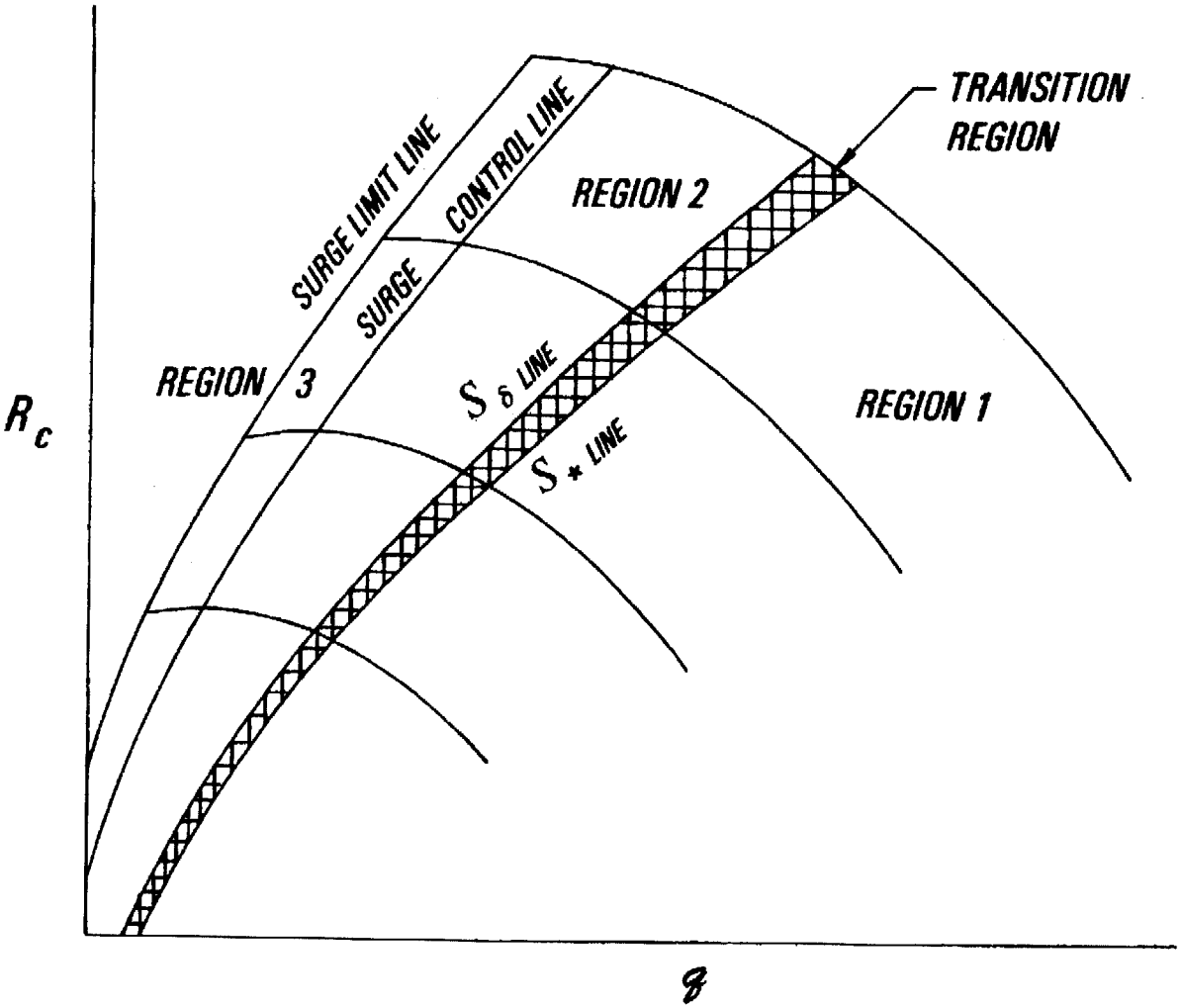
FIG. 1 shows a compressor map with three boundaries between three regions plus a transition region.

Efficient operation demands avoiding recycling or blowing off gas for the purpose of antisurge control whenever possible (while still maintaining safety). It is possible to carry out performance control in such a manner as to minimize recycle, which means avoiding it when possible, and preventing excessive recycle when it is necessary to protect compressors. This type of performance control involves keeping compressors the same distance from surge when their operation approaches the surge region. A load-balancing technique is described in this section and is illustrated in FIG. 1 as three boundaries between three regimes plus a transition region.

Region 1 (Far from Surge)

A distance from the surge control line must be defined beyond which there is no immediate threat of surge. When the compressors' operating points all reside at least this far from their surge control lines, performance of the compressors can be manipulated to balance pressure ratio. For flexibility, a function of pressure ratio, $f_2(R_c)$, is defined for control purposes. This function will bring the balancing parameter value in this region to less than unity and allow the marriage of Region 1 with Region 2 through the Transition Region.

Region 2 (Near Surge)

When the compressor is near its surge control line, a parameter that describes each compressor's distance from this line should be defined. This parameter should be maintained equal for each compressor. A possible parameter would be $$S_s = \frac{f_1(R_c)}{q_s^2}$$

where:

$S_s$=surge parameter $R_c$=pressure ratio across the compressor, $P_d/P_s$ $p_d$=absolute pressure at discharge $p_s$=absolute pressure in suction $q_s$=reduced flow at suction side of the compressor, $\sqrt{\Delta p_{o,s}/p_s}$ $\Delta p_{o,s}$=flow measurement signal in suction The function $f_1$ returns the value $q_s^2$, on the surge limit line, for the given value of the independent variable $R_c$. Therefore, $S_s$ goes to unity on the surge limit line. It is less than unity to the safe (right) side of the surge limit line. A safety margin, b, is added to $S_s$ to construct the surge control line, $S=S_s+b$. Then the definition for the distance between the operating point and the surge control line is simply $\delta=1-S$, which describes a parameter that is positive in the safe region (to the right of the surge control line), and zero on the surge control line.

Load balancing near the surge control line entails manipulating the performance of each compressor such that all the compressors'δ's are related by proportioning constants-allowing them to go to zero simultaneously. Thus, no one compressor will recycle until all must recycle. This improves the energy efficiency of the process since recycling gas is wasteful from an energy consumption standpoint (but not from a safety standpoint). It also does not permit any compressor to be in much greater jeopardy of surging than any others-so they share the "danger load" as well.

Region 3 (In Recycle)

When recycle is required for the safety of the machines, another constraint must be included to determine a unique operating condition. For the balancing parameter, we define $$S_p = S[1+\dot{m}_v] = S\left[1 + C_v\frac{p_1}{\sqrt{T_1}} f_3(R_{c,v})\right]$$

where:

$S_p$=balancing parameter $\dot{m}_v$=relative mass flow rate through the recycle valve $C_v$=valve flow coefficient, $f_v(v)$ v=valve stem position $p_1$=pressure of the gas entering the valve $T_1$=temperature of the gas entering the valve $f_3(R_{c,v})=[1-C_a(1-1/R_{c,v})]\sqrt{1-1/R_{c,v}}$, $[f_3(R_{c,v})\leqq\sqrt{0.148/C_a}]$ $C_a$=constant $R_{c,v}$=pressure ratio across the valve The parameter $S_p$ is identical to S when the recycle valve is closed ($\dot{m}_v=0$), therefore, it can be used in Region 2 as well. However, unlike S, $S_p$ increases above unity when the operating point is on the surge control line and the recycle valve is open. Therefore, balancing $S_p$ results in unique operation for any conditions.

To make $S_p$, more flexible, we can include a proportioning constant, β, as follows:

$$S_p^*=[1-\beta(1-S)][1+\dot{m}_v]$$

In this fashion, the balance can be customized, yet all compressors arrive at their surge control lines simultaneously.

Figure 3:
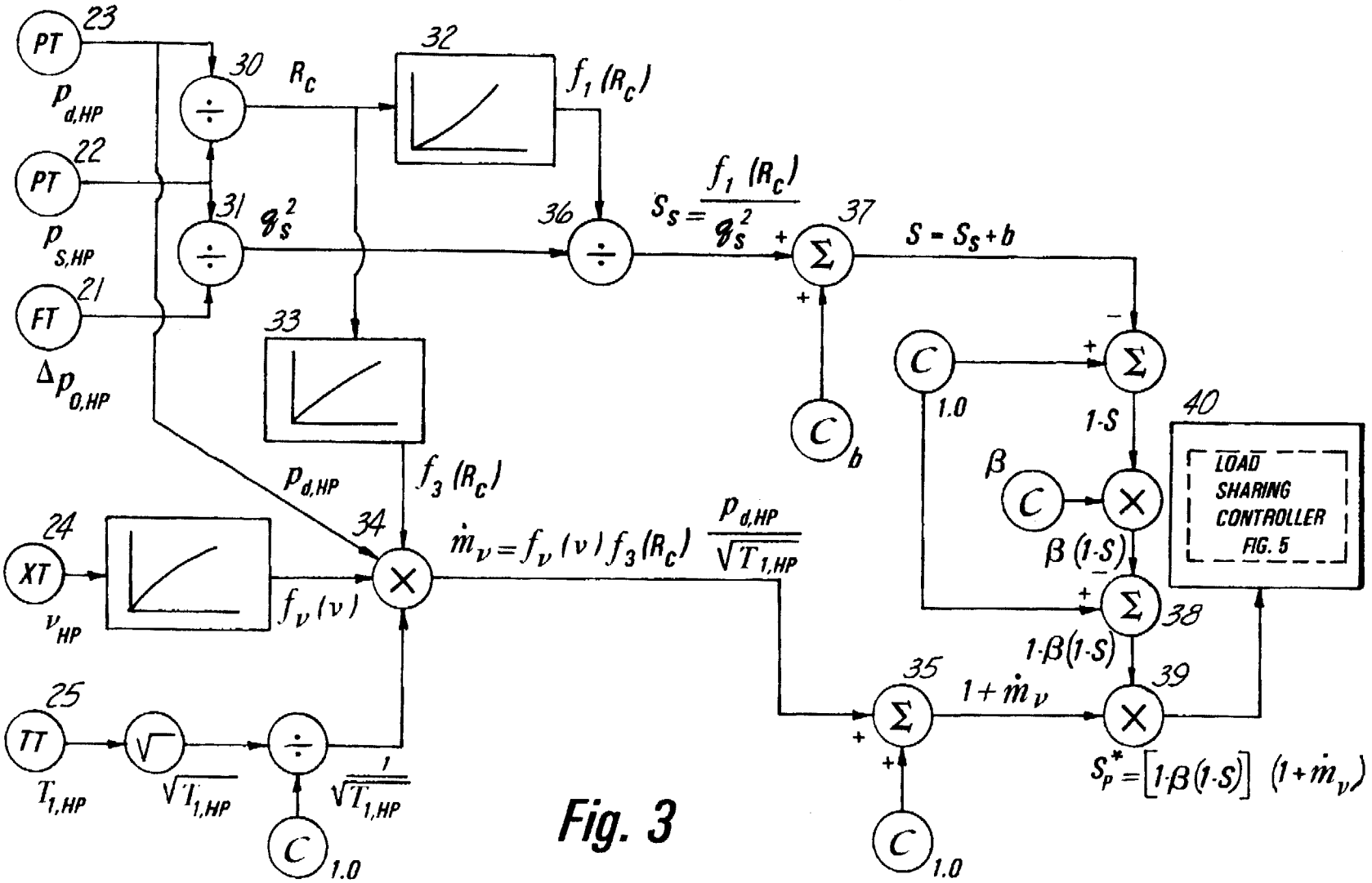
FIG. 3 shows a block diagram of a control scheme for a series compressor network, inputting to a Load Sharing Controller.

A block diagram of the calculation of the balancing parameter $S_p^*$ is shown in FIG. 3 where transmitter data from a high-pressure compressor (shown in FIG. 1) are computed to define $S_p^*$ as an input to a Load Sharing Controller. In the figure, a module 30 calculates pressure ratio ($R_c$) which is assumed to be accurate for both the compressor and the recycle valve. Another module 31 calculates reduced flow through the compressor (by equation $q_s^2=\Delta p_{o,s}/p_s$) while two function characterizers 32, 33 characterize the pressure ratio [$f_1(R_c)$, $f_3(R_c)$].

A multiplier 34 determines recycle relative mass flow ($\dot{m}_v$) from the function of pressure ratio [$f_3(R_c)$], absolute pressure at discharge ($p_{d,HP}$) 23, and with data from both the recycle valve stem position transmitter [$f_v(v)$] 24 and the temperature transmitter ($1/\sqrt{T_{1,HP}}$)25. Recycle relative mass flow is then added to a constant ($1+\dot{m}_v$)35.

A divider 36 yields a surge parameter ($S_s$) which is acted on by another module 37 that sums this value and a safety margin (b) to describe a surge parameter (S). Following a sequence of operations on the S parameter, a summing module 38 generates $1-\beta(1-S)$ that is multiplied by $1+\dot{m}_v$, thereby defining the balancing parameter $S_p^*$ 39 as an input to a Load Sharing Controller 40.

From the above discussion, with the appropriate choice of balancing parameter in the recycle region (Region 3), the shift from Region 2 to Region 3 (and back again) is handled automatically.

Figure 4:
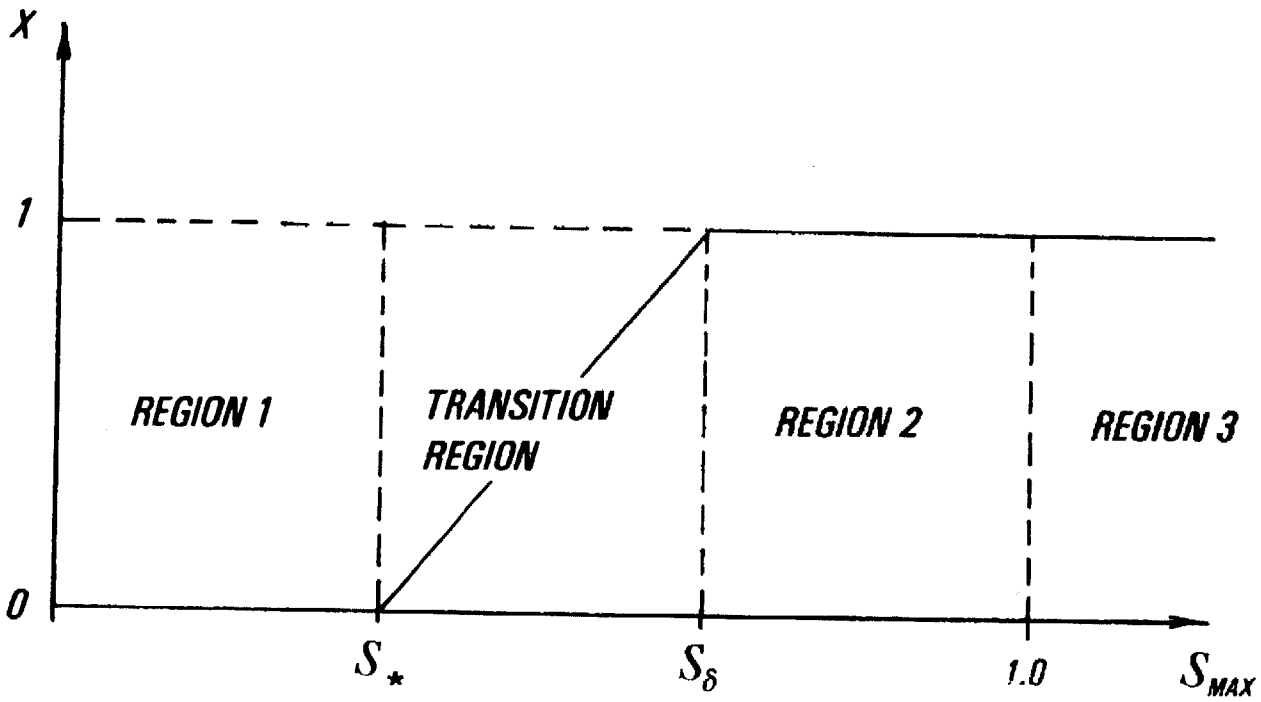
FIG. 4 shows a plot of parameter x versus parameter $S_{max}$.

In order to balance on different variables, it is necessary to define the set point and process variable for the control loop as a function of the location of the operating point on the compressor map. One way to accomplish this is to define a parameter, x, such that $$x = \begin{cases} 1 & \text{for } S_\delta \leqq S_{max} \\ \dfrac{S_{max}-S_*}{S_\delta - S_*} & \text{for } S_* < S_{max} < S_\delta \\ 0 & \text{for } S_{max} \leqq S_* \end{cases}$$

where:

$S_{max}$=maximum S value (nearest surge) for any compressor in the network at a given time $S_*$=right boundary of Transition Region $S_\delta$=left boundary of Transition Region A plot of x versus $S_{max}$ is shown in FIG. 4. Note that x is the same for all compressors and is calculated using parameters corresponding to the compressor nearest its surge line. Now a balancing parameter, B, can be defined as a function of x:

$$B=(1-x)f_2(R_c)+x[1-\beta(1-S)][1+\dot{m}_v]=\beta_2+\beta_1 S_p^* \text{tm} \quad (a)$$

and it is easy to see that $$\beta_1=x \text{ and } \beta_2=(1-x)f_2(R_c)$$

The function of pressure ratio $f_2(R_c)$, in Eq. (a), should be one that is monotonic and always less than $S_\delta$ to assure that B is also monotonic.

Eq. (a) is used to define both the process variable and the set point for each load balancing controller. For the process variable, the value $S_p^*$, for the specific compressor at hand, is used to calculate B. To compute the set point, an average of all B's is calculated.

Figure 5:
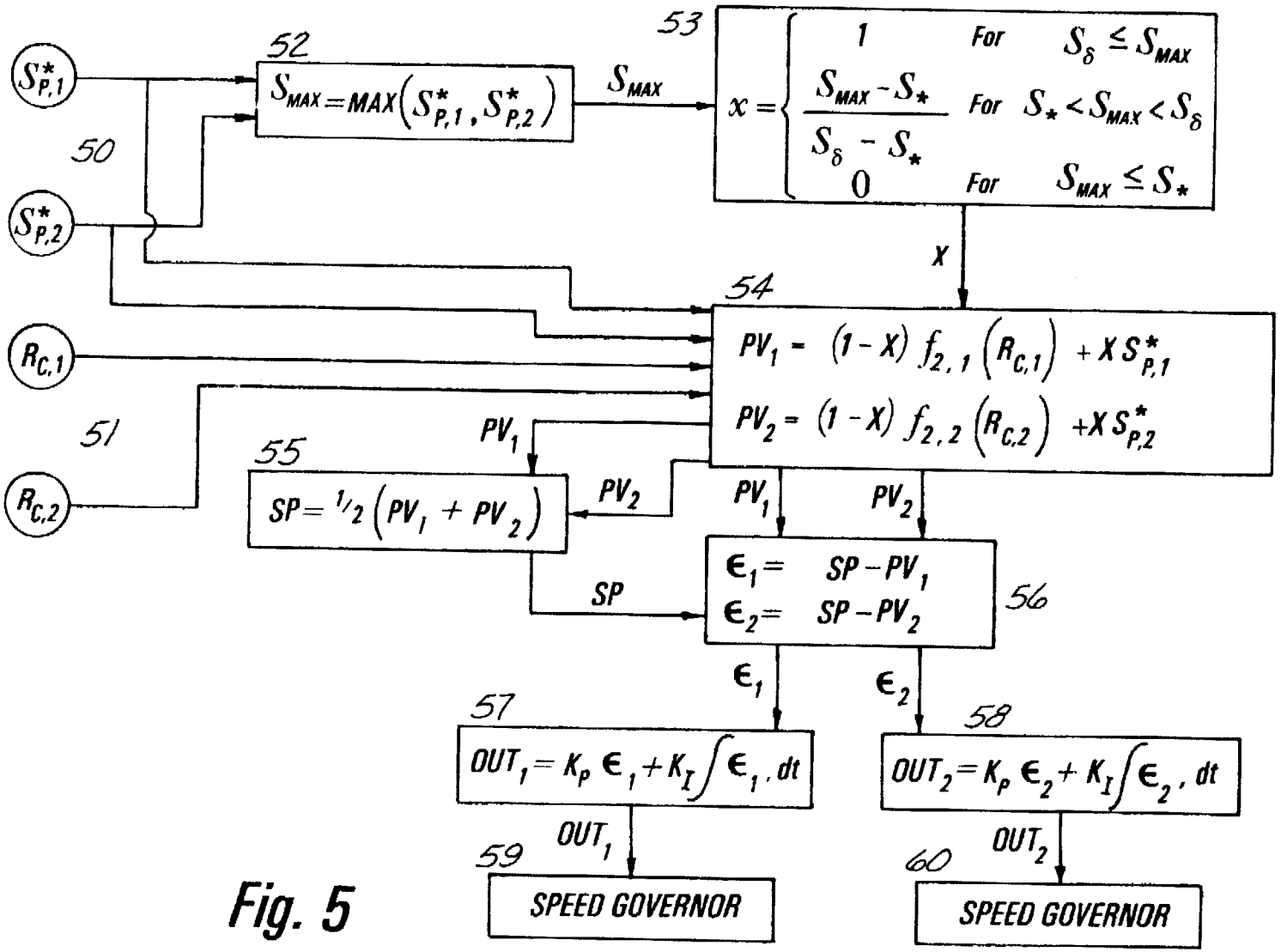
FIG. 5 shows a block diagram of a Load Sharing Controller for turbocompressors operating in series.

FIG. 5 details the use of Eq. (a) in a block diagram of the Load Sharing Controller (designated in FIG. 3) for a two-compressor network, wherein balancing parameters ($S_{p,1}$* $S_{p,2}$*) 50 are affected by a module 52 that generates a maximum S value ($S_{max}$) used in determining a parameter (x) 53. Additionally, pressure ratios ($R_{c,1}$, $R_{c,2}$) 51 along with the balancing parameters 50 and the x parameter 53, assist in computing process variables ($PV_1$, $PV_2$) 54 and, in turn, a set point (SP) 55. Another module 56 then calculates error ($\epsilon_1$, $\epsilon_2$) used to derive output signals 57, 58 which are subsequently transmitted to specific compressor speed governors 59, 60.

Alternatives to the above load balancing algorithm are described by balancing on parameters other than pressure ratio. Examples of such parameters are rotational speed, power, and distance to driver limits such as temperature, speed, torque and power. Other forms of the surge parameter, S, could also be devised; examples are $$S=\frac{\Delta p_c}{\Delta p_o} \text{ and } S=\frac{f(h_r)}{q_s^2}$$

where:

$\Delta p_c$=differential pressure rise across the compressor $h_r$=reduced head, $(R_c^{\sigma}-1)/\sigma$ $\sigma=(k-1)/\eta_p k \log T_s/T_d/\log p_s/p_d$ k=isentropic exponent $\eta_p$=polytropic efficiency $T_d$=discharge temperature $T_s$=suction temperature $p_d$=discharge pressure $p_s$=suction pressure Balancing during recycle can be accomplished without computing the relative mass flows through the recycle valves. For example, it is possible to balance using only the combination of a function of pressure ratio, $f_3(R_{c,v})$, and a function of the recycle valve position, $f_v(v)$; or even using $f_v(v)$ by itself. Moreover, compensation can be made for temperature differences. These methods can also be applied to compressors in parallel.

Obviously many modifications and variations of the present invention are possible in light of the above teachings. It is, therefore, to be understood that within the scope of the appended claims, the invention may be practiced otherwise than as specifically described.

We claim:

1. A method for controlling a compression system comprising at least two compressors, at least one driver, and a plurality of devices for varying the performance of said compressors, the method comprising the steps of:

(a) defining a surge parameter, S, representing a distance between an operating point and a surge line for each compressor;

(b) specifying a value, $S_*$, of said surge parameter for each compressor;

(c) manipulating the performance of said compressors to maintain a predetermined relationship between all compressors and/or drivers when the operating points of all compressors are farther from surge than said specified value, $S_*$, wherein said predetermined relationship is not a function of S; and (d) manipulating the performance of said compressors in such a fashion that all compressors reach their surge lines simultaneously.

2. The method of claim 1 wherein the step of defining a surge parameter, S, comprises the steps of:

(a) constructing a surge control line of a compressor in two-dimensional space;

(b) defining a function, $f_1(\cdot)$, which returns an abscissa value at surge for a given value of an ordinate variable; and (c) calculating a ratio of $f_1(\cdot)$ to the abscissa value using actual values of the abscissa and ordinate variables.

3. The method of claim 2 wherein the abscissa variable is a reduced flow, $\Delta p_o/p$, and the ordinate variable is a pressure ratio, $R_c$.

4. The method of claim 2 wherein the abscissa variable is a reduced flow, $\Delta p_o/p$, and the ordinate variable is a reduced head, $h_r=(R_r^{\sigma}-1)\sigma$.

5. The method of claim 2 wherein the abscissa variable is a differential pressure across a flow measurement device, $\Delta p_o$, and the ordinate variable is a pressure difference across the compressor, $\Delta p_c$.

6. The method of claim 1 wherein the step of maintaining a predetermined relationship between all compressors is accomplished by matching functions of pressure ratio, $R_c$.

7. The method of claim 6 wherein a pressure ratio is calculated by the steps of:

(a) sensing a pressure in a suction of said compressor;

(b) sensing a pressure in a discharge of said compressor;

(c) correcting said suction pressure and discharge pressure values to an absolute pressure scale; and (d) dividing said corrected discharge pressure by said corrected suction pressure to compute the pressure ratio.

8. The method of claim 1 wherein the step of maintaining a predetermined relationship between all compressors is accomplished by matching functions of power, P.

9. The method of claim 8 wherein the power is determined by sensing the power by a power measuring device and generating a power signal proportional to the power.

10. The method of claim 8 wherein a value proportional to the power is calculated by the steps of:

(a) sensing a value proportional to a suction pressure, $p_s$;

(b) sensing a value proportional to a suction temperature, $T_s$;

(c) sensing a value proportional to a discharge pressure, $P_d$;

(d) sensing a value proportional to a discharge temperature, $T_d$;

(e) sensing a value proportional to a differential pressure across a flow measurement device, $\Delta p_o$;

(f) calculating a value, $\sigma=\log T_d/T_s/\log p_d/p_s$;

(g) constructing a first value by multiplying the values proportional to the temperature, pressure, and differential pressure, all in one of: the suction or discharge of said compressor, and taking a square root of said product;

(h) calculating a pressure ratio, $R_c$, by dividing said discharge pressure by said suction pressure;

(i) calculating a reduced head, $h_r$, by raising said pressure ratio by a power equal to said $\sigma$, subtracting one, and dividing the difference by said $\sigma$; and (j) multiplying said first value by said reduced head.

11. The method of claim 1 wherein the step of maintaining a predetermined relationship between all drivers is accomplished by balancing said drivers' distances to a limit.

12. The method of claim 11 wherein said limit is a temperature limit of a gas turbine driver.

13. The method of claim 11 wherein said limit is a maximum speed limit of said driver.

14. The method of claim 11 wherein said limit is a minimum speed limit of said driver.

15. The method of claim 11 wherein said limit is a maximum torque limit of said driver.

16. The method of claim 11 wherein said limit is a maximum power limit of said driver.

17. The method of claim 1 wherein the step of maintaining a predetermined relationship between all compressors is accomplished by matching functions of rotational speed, N.

18. The method of claim 17 wherein the rotational speed is determined by sensing the rotational speed by a speed measuring device and generating a speed signal proportional to the speed.

19. A method for controlling a compression system comprising at least two compressors, at least one driver, and a plurality of devices for varying the performance of said compressors, relief means, and instrumentation, the method comprising the steps of:

(a) defining a surge parameter, S, representing a distance between an operating point and a surge line for each compressor;

(b) calculating a value of S for each compressor based on signals from said instrumentation;

(c) determining a maximum value, $S_{max}$, of all values of S for all compressors;

(d) specifying a value, $S_*$, of said surge parameter for each compressor;

(e) specifying a value, $S_\delta$, of said surge parameter as close or closer to surge than $S_*$ for each compressor;

(f) constructing a function, $f_2(\cdot)$, of pressure ratio, $R_c$, for each compressor;

(g) computing a value for the pressure ratio, $R_c$, for each compressor;

(h) calculating a value of a scaling factor, x, $(0 \leqq x \leqq 1)$;

(i) calculating a value which is a function of the state of said relief means, $f_v(v)$;

(j) calculating a value of a balancing parameter, $B=(1-x)f_2(R_c)+x[1-\beta(1-S)][1+f_v(v)]$, for each compressor;

(k) defining a value of a set point for said balancing parameter for each compressor; and (l) manipulating the performance of said compressors to match said balancing parameters to said set point for each compressor.

20. A method for controlling a compression system comprising at least two compressors, at least one driver, and a plurality of devices for varying the performance of said compressors, relief means, and instrumentation, the method comprising the steps of:

(a) defining a surge parameter, S, representing a distance between an operating point and a surge line for each compressor;

(b) calculating a value of S for each compressor based on signals from said instrumentation;

(c) determining a maximum value, $S_{max}$, of all values of S for all compressors;

(d) specifying a value, $S_*$, of said surge parameter for each compressor;

(e) specifying a value, $S_\delta$, of said surge parameter as close or closer to surge than $S_*$ for each compressor;

(f) constructing a function, $f_2(\cdot)$, of power, P, for each compressor;

(g) computing a value for the power, P, for each compressor;

(h) calculating a value of a scaling factor, x, $(0 \leqq x \leqq 1)$;

(i) calculating a value which is a function of the state of said relief means, $f_v(v)$;

(j) calculating a value of a balancing parameter, $B=(1-x)f_2(P)+x[1-\beta(1-S)][1+f_v(v)]$, for each compressor;

(k) defining a value of a set point for said balancing parameter for each compressor; and (l) manipulating the performance of said compressors to match said balancing parameters to said set point for each compressor.

21. A method for controlling a compression system comprising at least two compressors, at least one driver, and a plurality of devices for varying the performance of said compressors, relief means, and instrumentation, the method comprising the steps of:

(a) defining a surge parameter, S, representing a distance between an operating point and a surge line for each compressor;

(b) calculating a value of S for each compressor based on signals from said instrumentation;

(c) determining a maximum value, $S_{max}$, of all values of S for all compressors;

(d) specifying a value, $S_*$, of said surge parameter for each compressor;

(e) specifying a value, $S_\delta$, of said surge parameter as close or closer to surge than $S_*$ for each compressor;

(f) constructing a function, $f_2(\cdot)$, of rotational speed, N, for each compressor;

(g) computing a value for the rotational speed, N, for each compressor;

(h) calculating a value of a scaling factor, x, $(0 \leqq x \leqq 1)$;

(i) calculating a value which is a function of the state of said relief means, $f_v(v)$;

(j) calculating a value of a balancing parameter, $B=(1-x)f_2(N)+x[1-\beta(1-S)][1+f_v(v)]$, for each compressor;

(k) defining a value of a set point for said balancing parameter for each compressor; and (l) manipulating the performance of said compressors to match said balancing parameters to said set point for each compressor.

22. The method of claim 19, 20, or 21 wherein said scaling factor is calculated as $x=\min\{1, \max[0, (S_{max}-S_*)/(S_\delta-S_*)]\}$.

23. The method of claim 19, 20, or 21 wherein v is taken to be a set point, OUT, for the relief means, obtained from an antisurge controller.

24. The method of claim 19, 20, or 21 wherein said function, $f_2(\cdot)$, is also a function of a pressure ratio, $R_c$, across the compressor.

25. The method of claim 19, 20, or 21 wherein said function, $f_v(\cdot)$, is a function of a mass flow rate, $\dot{m}$, through said relief means.

26. The method of claim 25 wherein calculating a value proportional to said mass flow rate, $\dot{m}$, through said relief means comprises the steps of:

(a) constructing a function of a set point, $f_5(OUT)$, to represent a flow coefficient, $C_v$, of the relief means;

(b) constructing a function of the pressure ratio across the relief means in accordance with ISA or a valve manufacturer;

(c) calculating a first product by multiplying said function of said set point by said function of pressure ratio;

(d) calculating a second product by multiplying said first product by an absolute pressure, $p_1$, at an inlet to said relief means; and (e) dividing said second product by a square root of an absolute temperature, $T_1$, at said inlet to said relief means.

27. The method of claim 26 wherein the function of pressure ratio across the relief means is calculated as $$f_3\left(\frac{p_2}{p_1}\right)=\left[1-C_e\left(1-\frac{p_2}{p_1}\right)\right]\sqrt{1-\frac{p_2}{p_1}}\ .$$

28. The method of claim 26 wherein the absolute pressure, $p_1$, is assumed constant.

29. The method of claim 26 wherein the absolute temperature, $T_1$, is assumed constant.

30. The method of claim 25 wherein calculating a value proportional to said mass flow rate, $\dot{m}$, through said relief means comprises the steps of:

(a) sensing a differential pressure across a flow measurement device;

(b) sensing a pressure in the neighborhood of said flow measurement device;

(c) sensing a temperature in the neighborhood of said flow measurement device;

(d) calculating a product by multiplying the values of said differential pressure and said pressure; and (e) dividing said product by the value of said temperature and taking the square root of the entire quantity.

31. An apparatus for controlling a compression system comprising at least two compressors, at least one driver, and a plurality of devices for varying the performance of said compressors, the apparatus comprising:

(a) means for defining a surge parameter, S, representing a distance between an operating point and a surge line for each compressor;

(b) means for specifying a value, $S_*$, of said surge parameter for each compressor;

(c) means for manipulating the performance of said compressors to maintain a predetermined relationship between all compressors and/or drivers when the operating points of all compressors are farther from surge than said specified value, $S_*$, wherein said predetermined relationship is not a function of S; and (d) means for manipulating the performance of said compressors in such a fashion that all compressors reach their surge lines simultaneously.

32. The apparatus of claim 31 wherein the means for defining a surge parameter, S, comprises:

(a) means for constructing a surge control line of a compressor in two-dimensional space;

(b) means for defining a function, $f_1(\cdot)$, which returns an abscissa value at surge for a given value of an ordinate variable; and (c) means for calculating a ratio of $f_1(\cdot)$ to the abscissa value using actual values of the abscissa and ordinate variables.

33. The apparatus of claim 32 wherein the abscissa variable is a reduced flow, $\Delta p_o/p$, and the ordinate variable is a pressure ratio, $R_c$.

34. The apparatus of claim 32 wherein the abscissa variable is a reduced flow, $\Delta p_o/p$, and the ordinate variable is a reduced head, $h_r=(R_c^{\sigma}-1)/\sigma$.

35. The apparatus of claim 32 wherein the abscissa variable is a differential pressure across a flow measurement device, $\Delta p_o$, and the ordinate variable is a pressure difference across the compressor, $\Delta p_c$.

36. The apparatus of claim 31 wherein the means for maintaining a predetermined relationship between all compressors is accomplished by matching functions of pressure ratio, $R_c$.

37. The apparatus of claim 36 wherein a pressure ratio is calculated by:

(a) means for sensing a pressure in a suction of said compressor;

(b) means for sensing a pressure in a discharge of said compressor;

(c) means for correcting said suction pressure and discharge pressure values to an absolute pressure scale; and (d) means for dividing said corrected discharge pressure by said corrected suction pressure to compute the pressure ratio.

38. The apparatus of claim 31 wherein the means for maintaining a predetermined relationship between all compressors is accomplished by matching functions of power, P.

39. The apparatus of claim 38 wherein the power is determined by sensing the power by a power measuring device and generating a power signal proportional to the power.

40. The apparatus of claim 38 wherein a value proportional to the power is calculated by:

(a) means for sensing a value proportional to a suction pressure, $p_s$;

(b) means for sensing a value proportional to a suction temperature, $T_s$;

(c) means for sensing a value proportional to a discharge pressure, $P_d$;

(d) means for sensing a value proportional to a discharge temperature, $T_d$;

(e) means for sensing a value proportional to a differential pressure across a flow measurement device, $\Delta p_o$;

(f) means for calculating a value, $\sigma=\log T_d/T_s/\log p_d/p_s$;

(g) means for constructing a value proportional to a mass flow rate, $\dot{m}$, by multiplying the values proportional to the temperature, pressure, and differential pressure, all in one of: the suction or discharge of said compressor, and taking a square root of said product;

(h) means for calculating a pressure ratio, $R_c$, by dividing said discharge pressure by said suction pressure;

(i) means for calculating a reduced head, $h_r$, by raising said pressure ratio by a power equal to said $\sigma$, subtracting one, and dividing the difference by said $\sigma$; and (j) means for multiplying said value proportional to the mass flow by said reduced head.

41. The apparatus of claim 31 wherein the means for maintaining a predetermined relationship between all drivers is accomplished by balancing said drivers' distances to a limit.

42. The apparatus of claim 41 wherein said limit is a temperature limit of a gas turbine driver.

43. The apparatus of claim 41 wherein said limit is a maximum speed limit of said driver.

44. The apparatus of claim 41 wherein said limit is a minimum speed limit of said driver.

45. The apparatus of claim 41 wherein said limit is a maximum torque limit of said driver.

46. The apparatus of claim 41 wherein said limit is a maximum power limit of said driver.

47. The apparatus of claim 31 wherein the means for maintaining a predetermined relationship between all compressors is accomplished by matching functions of rotational speed, N.

48. The apparatus of claim 47 wherein the rotational speed is determined by sensing the rotational speed by a speed measuring device and generating a speed signal proportional to the speed.

49. An apparatus for controlling a compression system comprising at least two compressors, at least one driver, and a plurality of devices for varying the performance of said compressors, relief means, and instrumentation, the apparatus comprising:

(a) means for defining a surge parameter, S, representing a distance between an operating point and a surge line for each compressor;

(b) means for calculating a value of S for each compressor based on signals from said instrumentation;

(c) means for determining a maximum value, $S_{max}$, of all values of S for all compressors;

(d) means for specifying a value, $S_*$, of said surge parameter for each compressor;

(e) means for specifying a value, $S_\delta$, of said surge parameter as close or closer to surge than $S_*$ for each compressor;

(f) means for constructing a function, $f_2(\cdot)$, of pressure ratio, $R_c$, for each compressor;

(g) means for computing a value for the pressure ratio, $R_c$, for each compressor;

(h) means for calculating a value of a scaling factor, x, $(0 \leqq x \leqq 1)$;

(i) means for calculating a value which is a function of the state of said relief means, $f_v(v)$;

(j)) means for calculating a value of a balancing parameter, $B=(1-x)f_2(R_c)=x[1-\beta(1-S)][1+f_v(v)]$, for each compressor;

(k) means for defining a value of a set point for said balancing parameter for each compressor; and (l) means for manipulating the performance of said compressors to match said balancing parameters to said set point for each compressor.

50. An apparatus for controlling a compression system comprising at least two compressors, at least one driver, and a plurality of devices for varying the performance of said compressors, relief means, and instrumentation, the apparatus comprising:

(a) means for defining a surge parameter, S, representing a distance between an operating point and a surge line for each compressor;

(b) means for calculating a value of S for each compressor based on signals from said instrumentation;

(c) means for determining a maximum value, $S_{max}$, of all values of S for all compressors;

(d) means for specifying a value, $S_*$, of said surge parameter for each compressor;

(e) means for specifying a value, $S_\delta$, of said surge parameter as close or closer to surge than $S_*$ for each compressor;

(f) means for constructing a function, $f_2(\cdot)$, of power, P, for each compressor;

(g) means for computing a value for the power, P, for each compressor;

(h) means for calculating a value of a scaling factor, x, $(0 \leqq x \leqq 1)$;

(i) means for calculating a value which is a function of the state of said relief means, $f_v(v)$;

(j) means for calculating a value of a balancing parameter, $B=(1-x)f_2(P)+x[1-\beta(1-S)][1+f_v(v)]$, for each compressor;

(k) means for defining a value of a set point for said balancing parameter for each compressor; and (l) means for manipulating the performance of said compressors to match said balancing parameters to said set point for each compressor.

51. An apparatus for controlling a compression system comprising at least two compressors, at least one driver, and a plurality of devices for varying the performance of said compressors, relief means, and instrumentation, the apparatus comprising:

(a) means for defining a surge parameter, S, representing a distance between an operating point and a surge line for each compressor;

(b) means for calculating a value of S for each compressor based on signals from said instrumentation;

(c) means for determining a maximum value, $S_{max}$, of all values of S for all compressors;

(d) means for specifying a value, $S_*$, of said surge parameter for each compressor;

(e) means for specifying a value, $S_\delta$, of said surge parameter as close or closer to surge than $S_*$ for each compressor;

(f) means for constructing a function, $f_2(\cdot)$, of rotational speed, N, for each compressor;

(g) means for computing a value for the rotational speed, N, for each compressor;

(h) means for calculating a value of a scaling factor, x, $(0 \leqq x \leqq 1)$;

(i) means for calculating a value which is a function of the state of said relief means, $f_v(v)$;

(j) means for calculating a value of a balancing parameter, $B=(1-x)f_2(N)+x[1-\beta(1-S)][1+f_v(v)]$, for each compressor;

(k) means for defining a value of a set point for said balancing parameter for each compressor; and (l) means for manipulating the performance of said compressors to match said balancing parameters to said set point for each compressor.

52. The apparatus of claim 49, 50, or 51 wherein said scaling factor is calculated as $x=\min\{1, \max[0, (S_{max}-S_*)/(S_{67}-S_*)]\}$.

53. The apparatus of claim 49, 50, or 51 wherein v is taken to be a set point, OUT, for the relief means, obtained from an antisurge controller.

54. The apparatus of claim 49, 50, or 51 wherein said function, $f_v(\cdot)$, is also a function of a pressure ratio, $R_c$, across the compressor.

55. The apparatus of claim 49, 50, or 51 wherein said function, $f_v(\cdot)$, is a function of a mass flow rate, $\dot{m}$, through said relief means.

56. The apparatus of claim 55 wherein calculating a value proportional to said mass flow rate, $\dot{m}$, through said relief means comprises:

(a) means for constructing a function of a set point, $f_5(OUT)$, to represent a flow coefficient, $C_v$, of the relief means;

(b) means for constructing a function of the pressure ratio across the relief means in accordance with ISA or a valve manufacturer;

(c) means for calculating a first product by multiplying said function of said set point by said function of pressure ratio;

(d) means for calculating a second product by multiplying said first product by an absolute pressure, $p_1$, at an inlet to said relief means; and (e) means for dividing said second product by a square root of an absolute temperature, $T_1$, at said inlet to said relief means.

57. The apparatus of claim 56 wherein the function of pressure ratio across the relief means is calculated as $$f_3\left(\frac{p_2}{p_1}\right)=\left[1-C_a\left(1-\frac{p_2}{p_1}\right)\right]\sqrt{1-\frac{p_2}{p_1}}\ .$$

58. The apparatus of claim 56 wherein the absolute pressure, $p_1$, is assumed constant.

59. The apparatus of claim 56 wherein the absolute temperature, $T_1$, is assumed constant.

60. The apparatus of claim 55 wherein calculating a value proportional to said mass flow rate, $\dot{m}$, through said relief means comprises:

(a) means for sensing a differential pressure across a flow measurement device;

(b) means for sensing a pressure in the neighborhood of said flow measurement device;

(c) means for sensing a temperature in the neighborhood of said flow measurement device;

(d) means for calculating a product by multiplying the values of said differential pressure and said pressure; and (e) means for dividing said product by the value of said temperature and taking the square root of the entire quantity.

* * * * *

UNITED STATES PATENT AND TRADEMARK OFFICE

CERTIFICATE OF CORRECTION

PATENT NO. : 5,743,715

DATED : April 28, 1998

INVENTOR(S) : Staroselsky, et al.

It is certified that error appears in the above-identified patent and that said Letters Patent is hereby corrected as shown below:

Column 3, line 8: delete " $P_d/P_s$ " and insert -- $p_d/p_s$ --.

Column 3, line 64: delete " $S_p^*$ " and insert -- $S_p^*$ --.

Column 4, lines 2, 4, 22, 53, and 63: delete " $S_p^*$ " and insert -- $S_p^*$ --.

Column 4, line 35: delete the four (4) occurrences of " $S_*$ " in the equation and insert -- $S_*$ --.

Column 4, line 43: delete " $S_*$ " and insert -- $S_*$ --.

Column 4, line 53: delete "tm (a)" from the equation.

Column 4, line 53: delete "(a)" at the end of the equation and insert --(a)-- so that it precedes the equation.

Column 5, lines 1 and 2: delete " $\left(S_{p,1}^*, S_{p,2}^*\right)$ ", and insert -- $\left(S_{p,1}^*, S_{p,2}^*\right)$ --.

Column 5, lines 53 and 59: delete " $S_*$ " and insert -- $S_*$ --.

UNITED STATES PATENT AND TRADEMARK OFFICE

CERTIFICATE OF CORRECTION

PATENT NO. : 5,743,715 Page 2 of 2

DATED : April 28, 1998

INVENTOR(S) : Staroselsky, et al.

It is certified that error appears in the above-identified patent and that said Letters Patent is hereby corrected as shown below:

Column 6, line 11: delete equation segment "$(R_r^{\sigma}-1)\sigma$" should read --$(R_c^{\sigma}-1)/\sigma$--

Column 6, line 41 and Column 10, line 27: delete "$\mathbf{P_d}$" and insert -- $\mathbf{p_d}$--.

Column 7, lines 24, 28, 56 and 59: delete "$S_*$ " and insert -- $S_*$ --.

Column 8, lines 21, 24, 40, and 41: delete "$S_*$ " and insert -- $S_*$ --.

Column 9, lines 33 and 39: delete "$S_*$ " and insert -- $S_*$ --.

Column 9, line 59: delete "$(R_c^{\sigma}-1)/\sigma$ " and insert --$(R_c^{\sigma}-1)/\sigma$ --.

Column 11, lines 13, 17, 49 and 52: delete "$S_*$ " and insert -- $S_*$ --.

Column 12, lines 16, 19, 38, and 39: delete "$S_*$" and insert -- $S_*$ --.

Column 12, line 39: delete the equation segment " $(S_{max} - S_*) / (S_{67} - S_*)$ " and insert -- $(S_{max} - S_*) / (S_\delta - S_*)$ --.

Signed and Sealed this

Twentieth Day of October, 1998

Bruce Lehman

*Attest:*

BRUCE LEHMAN

*Attesting Officer*

*Commissioner of Patents and Trademarks*